US005936587A

United States Patent [19]

Gudilev et al.

[11] Patent Number: 5,936,587

[45] Date of Patent: Aug. 10, 1999

[54] SMALL ANTENNA FOR PORTABLE RADIO EQUIPMENT

[75] Inventors: Alexandre V. Gudilev, Suwon; Dong-In Ha; Sang-Keun Bak, both of Seoul, all of Rep. of Korea

[73] Assignee: Samsung Electronics Co., Ltd., Rep. of Korea

[21] Appl. No.: 08/884,812

[22] Filed: Jun. 30, 1997

[30] Foreign Application Priority Data

Nov. 5, 1996 [KR] Rep. of Korea ..... 96-52132

[51] Int. Cl.[6] ..... H01Q 9/00

[52] U.S. Cl. ..... 343/752; 343/702; 343/749; 343/846

[58] Field of Search ..... 343/700 MS, 702, 343/749, 750, 751, 752, 846, 848

[56] References Cited

U.S. PATENT DOCUMENTS 4,313,121 1/1982 Campbell et al. ..... 343/790

4,684,953 8/1987 Hall ..... 343/725

5,706,016 1/1998 Harrison ..... 343/752

*Primary Examiner*—Don Wong

*Assistant Examiner*—Tho Phan

*Attorney, Agent, or Firm*—Dilworth & Barrese

[57] ABSTRACT

Disclosed is a small, lightweight antenna having a relatively high gain, particularly suited for use with a portable radio device such as a bidirectional pager. In an exemplary embodiment, the antenna includes a loaded monopole radiator and a ground radiator. The loaded monopole radiator includes first and second conductors on a printed circuit substrate, where the first conductor has a given length oriented in a horizontal direction. The second conductor has a meander line shape and is oriented in a vertical direction. The ground radiator includes separately a first ground and a second ground at a lower portion of the printed circuit substrate, where the first and second grounds are symmetrical with respect to the second conductor.

14 Claims, 9 Drawing Sheets

PRIOR ART

PRIOR ART

PRIOR ART

PRIOR ART

SMALL ANTENNA FOR PORTABLE RADIO EQUIPMENT

BACKGROUND OF THE INVENTION

1. Field of the Invention

The present invention relates to antennas, and, more specifically, to a small antenna particularly suitable for portable radio equipment, and having a radiator of meander line shape.

2. Description of the Related Art

As portable radio equipment has become miniature and light-weight in recent times, there has also been significant development in small antennas suitable for use in such equipment. Any such small antenna should be convenient and simple for a user to operate, and should have an omnidirectional antenna pattern in azimuth and a relatively high gain in the elevation. In addition, when the portable equipment is placed near a human body, the presence of the human body should minimally affect the basic characteristic of the antenna, that is, input impedance and gain variation.

One solution to meet the above requirements is disclosed in U.S. Pat. No. 4,700,194 to Ogawa et al, issued Oct. 13, 1987. According to the above patent, if the antenna current flows on a ground circuit and on the equipment terminal case, the current flowing on the antenna is varied if the terminal case is placed in the vicinity of the human body, so that the input impedance and the gain of the antenna may be further varied. As a result, even without using a quarter-wave trap or a balance to unbalance transformer (hereinafter, referred to as balun) as used in prior art sleeve antennas, good electrical isolation may be provided between the antenna and the ground circuit of a coaxial transmission line or of the electric circuit.

FIGS. 1A and 1B are diagrams showing the construction of a prior art quarter-wavelength microstrip antenna (hereinafter, referred to as QMSA) which is described in the above U.S. Pat. No. 4,700,194. In FIG. 1B, centering around a dielectric 61, the antenna includes a radiation element on one surface of the dielectric and a ground element on another surface. A first feed radiation element 62 (first feeding means) is electrically connected to a signal line of the transmission line. A second feed radiation element is constructed on the ground element so as to electrically connect the ground line of the transmission line and the ground element, which is located at a position where the voltage of the standing voltage wave induced on the ground element becomes minimum. Now, in a conventional microstrip antenna, the ground plane no longer acts as the ground if the size of the ground plane is small relative to the wavelength of the operating frequency. In this case, a sinusoidal variation of a voltage distribution, or a voltage standing wave is induced on the ground plane. As a result, a parasitic current is induced on the outer conductor of the coaxial transmission line. In the antenna of FIGS. 1A and 1B, to reduce the generation of such parasitic current to a minimum, the outer conductor of the transmission line is connected to the ground element at a second feed point where the voltage of the standing voltage wave induced on the ground element becomes minimum. With this structure, the parasitic current on the transmission line can be reduced or eliminated without any quarter-wave trap which is used in conventional sleeve antenna configurations. Accordingly, the variation of the antenna characteristics can be considerably reduced in the event that the antenna is placed in the vicinity of the human body or an electric circuit.

FIGS. 2 and 4 are diagrams showing variation of the gain characteristic depending upon lengths L, Gz of a quarter-wavelength microstrip antenna according embodiments of the prior art, and FIG. 3 is a diagram showing variation of the gain characteristic depending upon width W of a quarter-wavelength microstrip antenna according an embodiment of the prior art.

One disadvantage of the prior art quarter-wavelength microstrip antenna is that variation of the efficiency characteristic of the antenna depends considerably on the thickness of the printed circuit substrate (hereinafter, referred to as PCB). That is, the antenna gain is related to the thickness of the PCB. A thicker PCB results in higher gain, but increases the size and weight of the antenna, thereby causing inconvenience to the user as it is more difficult to carry. To the contrary, if the PCB is thin, while the antenna can be easily carried by a user, the gain of the antenna may be consequently diminished.

SUMMARY OF THE INVENTION

It is an object of the present invention to provide an antenna that is small in size, light in weight, and having a high gain so as to be easily transported and carried by a user and suitable for use with portable radio equipment. It is desired to minimize variation of the antenna characteristics when the antenna is provided near the human body.

In an exemplary embodiment of the present invention, a small antenna for a portable radio device includes a loaded monopole radiator and a ground radiator. The loaded monopole radiator includes first and second conductors on a printed circuit substrate, where the first conductor has a given length oriented in a horizontal direction, and the second conductor has a meander line shape and is oriented in a vertical direction. The ground radiator includes separately a first ground and a second ground at a lower portion of the printed circuit substrate, where the first and second grounds are symmetrical with respect to the second conductor.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE PREFERRED EMBODIMENT(S)

Figure 1A:
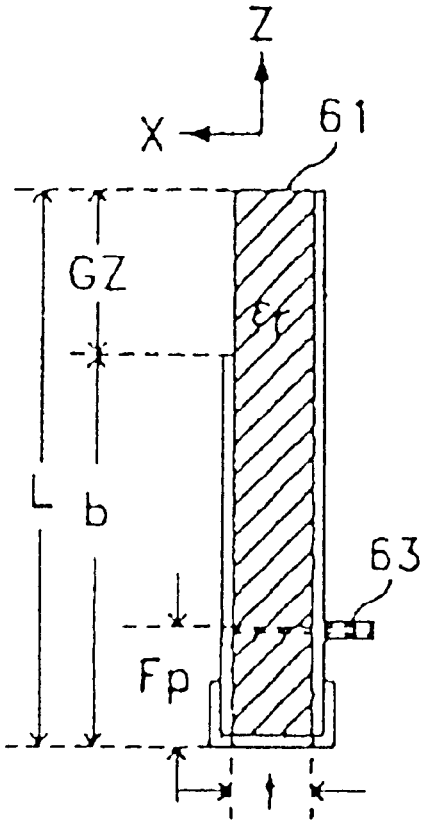
FIG. 1A PRIOR ART
FIGS. 1A and 1B are diagrams showing the construction of a prior art quarter-wavelength microstrip antenna in top and side views, respectively.

Hereinafter, a preferred embodiment of the present invention will be described with reference to the accompanying drawings, wherein like reference numerals are used to designate like or equivalent elements having the same function throughout the several drawings. Further, in the following description, numeral specific details such as concrete components composing the circuit and the frequencies of operation, are set forth to provide a more thorough understanding of the present invention. It will be apparent, however, to one skilled in the art that the present invention may be practiced without these specific details. The detailed description of known function and constructions unnecessarily obscuring the subject matter of the present invention will be avoided in the present disclosure.

Figure 5:
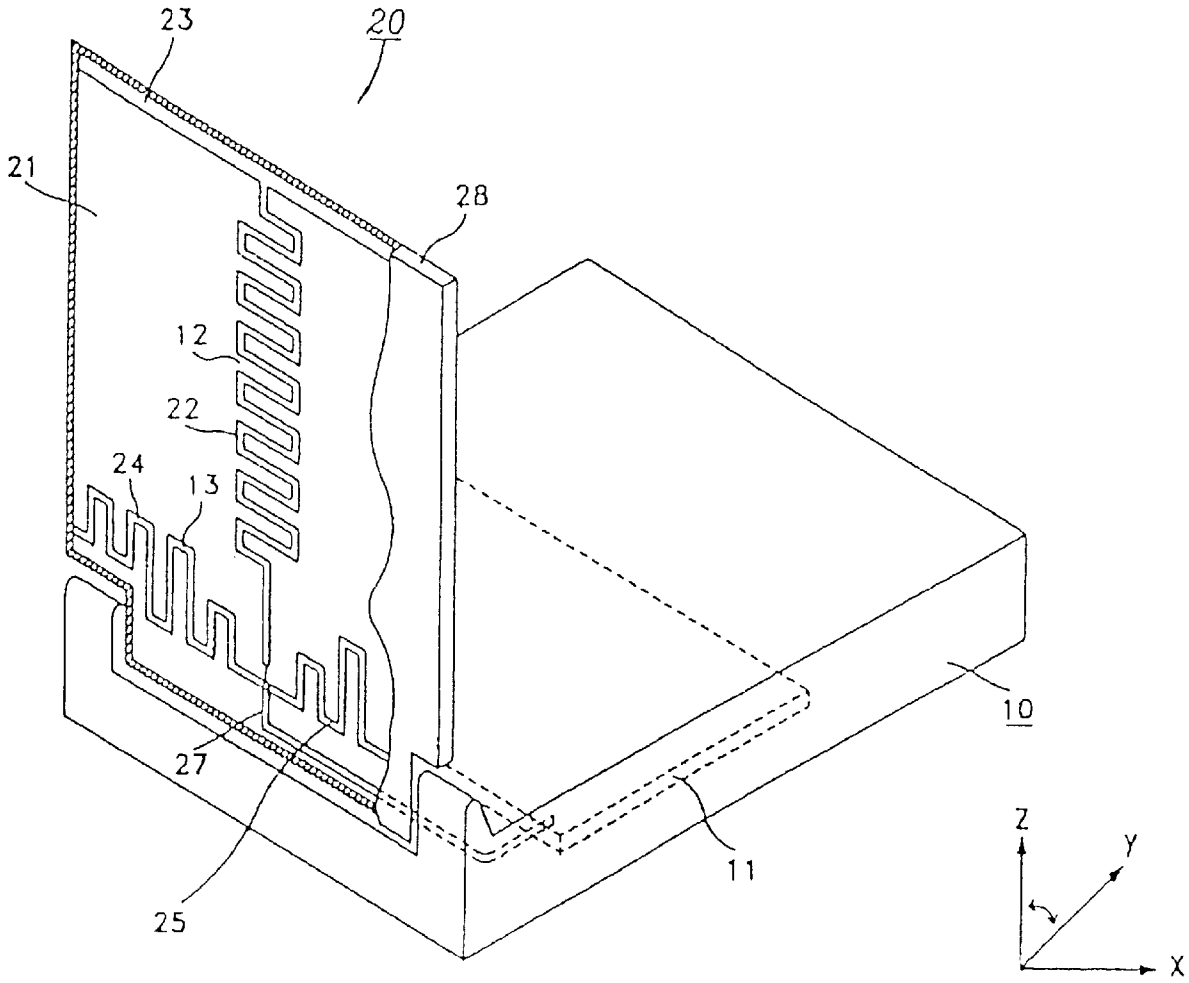
FIG. 5 is a diagram showing the construction of a monopole antenna according to an embodiment of the present invention.

FIG. 5 is a diagram showing the construction of a monopole antenna according to an embodiment of the present invention. The antenna is illustrated for use in conjunction with a two-way pager 10; however, it is understood that the invention has other applications. Referring to FIG. 5, an antenna system 20 is comprised of a conductor radiator 12 of a loaded monopole shape, a ground radiator 13 embodied with a meander line shape, and a coaxial transmission line 27 for connecting the conductor radiator 12 and the ground radiator 13 to a PCB 11 installed with a radio frequency power amplifier. The conductor radiator 12 and the ground radiator 13 are deposited at one major surface of the PCB 21, which can be installed in an antenna case 28 of the flip shape. The flip antenna case 28 moves, along with the antenna system 20, with respect to the housing of pager 10. That is, antenna system 20 moves between the Y and Z axis, where the pager housing is centered about the X axis. In operation, antenna system 20 is in a vertical position (oriented in the Z direction as shown in FIG. 5).

Figure 6:
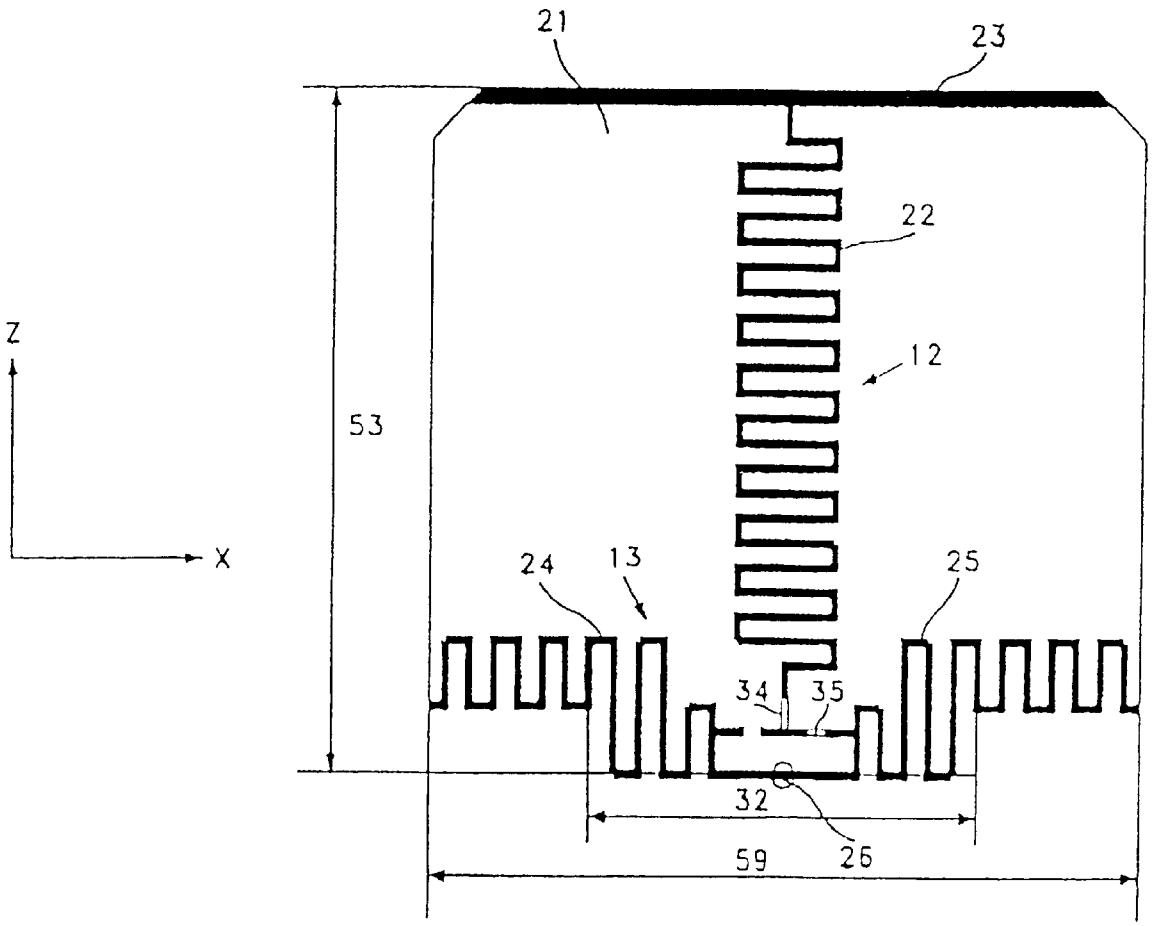
FIG. 6 is a detailed circuit diagram of the antenna of FIG. 5.

FIG. 6 is a detailed circuit diagram of the antenna of FIG. 5, showing specifically the PCB 21 of the antenna system 20 in detail. The conductor radiator 12 of the loaded monopole shape is composed of a horizonal conductor 23 and a vertical conductor 22, where the conductor 22 has the meander line shape. An upper end of the vertical conductor 22 is loaded by the horizontal conductor 23. An exemplary electrical length of vertical conductor 22 is 0.49 wavelength and that of the horizontal conductor 23 is 0.3 wavelength. This design is based in consideration of the fact that the length of the antenna having the highest gain among equivalent vertical monopole antennas is 0.625 wavelength. Further, the overall antenna system 20, which uses a loading unit and a meander line shape and the above lengths to maximize the gain, is particularly suitable for use with the rectangular or square flip shape case 28.

The ground radiator 13 is positioned in the lower portion of the PCB 21 of the antenna system 20 parallel to the horizontal conductor 23. In the configuration shown, the ground radiator 13 is placed in a reflective position on the vertical conductor 22 and is divided into first and second radiators 24 and 25 connected to a ground of the coaxial transmission line 27 at a ground position 26 of the feed point. To enhance the efficiency of the ground radiator 13, each of the first and second ground radiators 24 and 25 preferably has an electrical length of a quarter wavelength. The quality of the PCB 21 of the antenna system 20 for use in a preferred embodiment of the present invention may be FR-4, and the thickness thereof is, e.g., 0.25 mm. The PCB 21 thereof can be inserted into the flip-shape antenna case 28, composed of polycarbonate. A capacitor 34 and an inductor 35 are used for impedance matching.

Detailed operation of the antenna according to the preferred embodiment of the present invention is explained as follows. The antenna efficiency is determined by the radiation efficiency and further, the radiation efficiency can be determined using the following expression 1.

$$\eta = \frac{Rr}{Rr + RL} \qquad \text{[Expression1]}$$

wherein, $\eta$is the radiation efficiency, Rr is a radiation resistance (Ω). and RL is a loss resistance (Ω).

In the above expression 1, as the length of the radiator decreases, the radiation resistance Rr decreases.

To increase the radiation efficiency to a value close to the antenna efficiency, it is necessary to increase the length of the radiator having the high radiation resistance Rr, and to use a low loss conductor with a low resistance RL. Thus, embodiments of the present invention can be designed by employing a meander line shape for the conductor to reduce the physical length of the antenna radiator, while increasing the radiation efficiency by increasing the length of the radiator as a function of the wavelength. Finally, the gain of the antenna can be increased without increasing the physical length of the radiator.

In an article authored by K. Harchenko entitled "Antenna Conductor with Meander Line Shape" (Radio, No.8, 1979, P21), it is disclosed that the higher the meander line rate of the antenna becomes, the narrower the passband of the antenna. Therefore, as depicted in FIG. 6, the horizontal radiator 23 loaded on the radiator 22 is used in the embodiment of the present invention, so that the electric equivalent length can increase by the value required without excessively narrowing the antenna bandwidth. Accordingly, the resulting effect is that the antenna operates in a similar manner as an antenna with a radiator of increased length, thereby enhancing the antenna gain.

Figure 7:
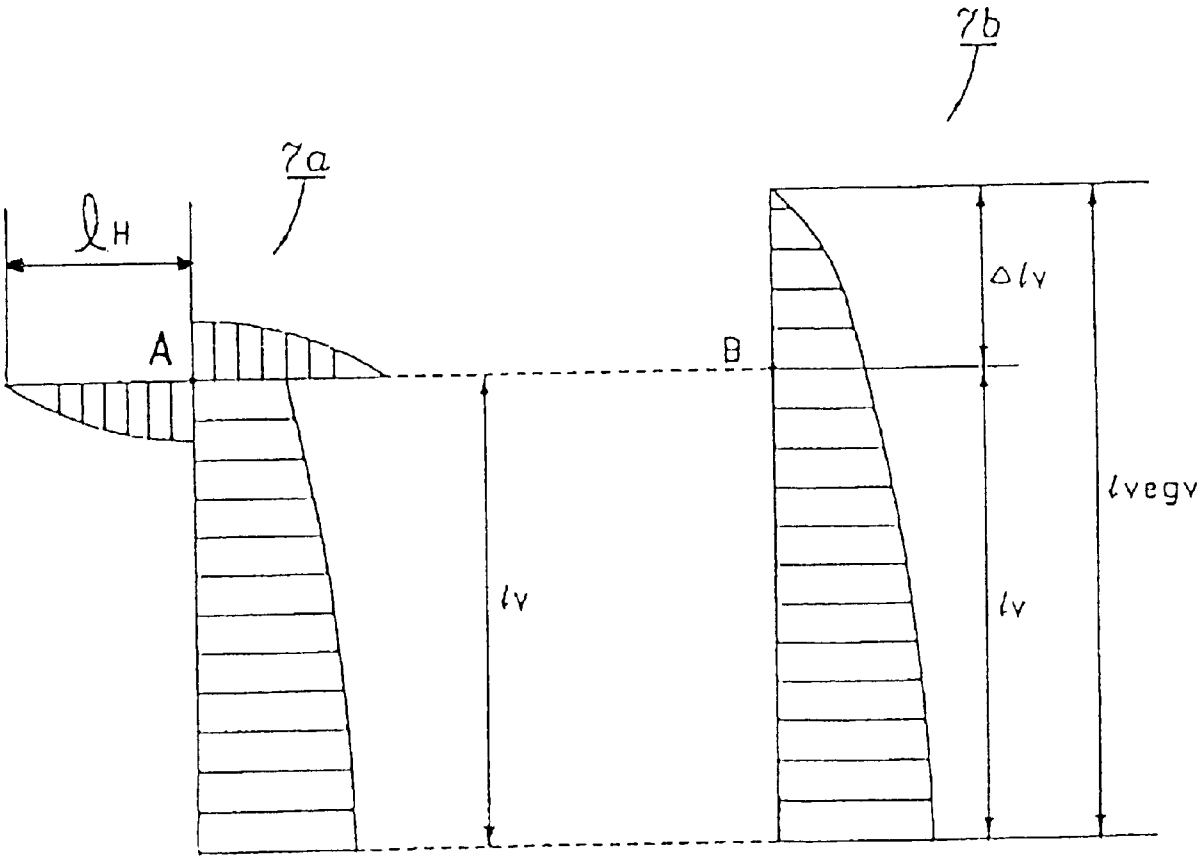
FIG. 7 is a diagram showing current distribution of a loaded monopole and an equivalent monopole.

FIG. 7 is a graph showing current distribution of a loaded monopole and an equivalent monopole, wherein portion 7*a* of the graph illustrates the loaded monopole radiator and current distribution thereof, and portion 7*b* illustrates the current distribution of the equivalent monopole antenna. It is desirable to obtain good current distribution in the vertical conductor of the antenna. Thus, the antenna operates in like manner when increasing as much as Δlv by the horizontal conductor (loaded radiator) used, which will be shown by following expression 2.

$$l\ veqv = lv + \Delta lv \qquad \text{Expression 2}$$

wherein Δlv is increased length of the equivalent vertical conductor.

For the loaded monopole antenna, unless the current value at an end point "A" (see FIG. 7) of the vertical conductor 22 becomes zero, the value is determined by reactive impedance of the horizontal conductor 23 of the loaded monopole antenna. Only when the input reactive impedance of the loaded radiator at point A is equal to that at point B of the equivalent monopole, then the vertical conductor of the antenna can increase by as much as Δl.

In this situation, the input reactive impedances XA and XB of the loaded radiator at positions A and B are as expressed in the following expressions 3 and 4.

$$XA = -j\frac{ZOH}{2}\mathrm{Cot}\left(\frac{2\pi}{\lambda}lH\right) \quad \text{[Expression3]}$$

wherein, lH is the length of the "arm" of the horizontal conductor of the loaded monopole (i.e., about half the total horizontal length of the overall horizontal conductor 23) and ZOH is the intrinsic impedance of the horizontal conductor of the loaded monopole.

$$XB = -jZOV\mathrm{Cot}\left(\frac{2\pi}{\lambda}\Delta lv\right) \quad \text{[Expression4]}$$

wherein ZOV is intrinsic impedance of the vertical conductor of the loaded monopole.

Moreover, if the two input reactive impedances XA and XB are equal to each other, Δlv will be obtained by following expression 5.

$$\Delta lv = \frac{\lambda}{2\pi}\arctan[2\frac{ZOV}{ZOH}\cdot\tan\left(\frac{2\pi}{\lambda}lH\right) \quad \text{[Expression5]}$$

As a result, lveqv is a sum of lv and Δlv, that is, lveqv=lv+Δlv. In other words, it can be seen that the physical length of the monopole antenna is extended as much as Δlv to be operated. Furthermore, the terminal case coated with the metal film or the ground of the installed PCB can serve as the ground of the general monopole antenna. Hence, when the user grasps the terminal by hand, the radiation efficiency can be still reduced even though the ground thereof serves as the ground radiator. See, "Mobile Antenna Systems Handbook" by K. Fujimoto and J. R. James, Artech House, Boston-London, 1994, P217–243.

The first and second ground radiators 24 and 25 are adapted in the preferred embodiment of the present invention to minimizing the effect of the human body on the radiation of the monopole antenna when the terminal is placed near the human body. Since the antenna current is separated from the ground of the two-way pager 10, the reduction of the radiation efficiency can be minimized when the device is placed in a user's hand. Also, when the user actually utilizes the terminal, the first and second ground radiators 24 and 25 are included on the PCB 21 of the antenna installed at an upper surface of the two-way pager 10 to be furthest away from the human body during use.

Radiation from the first and second ground radiators 24 and 25 depends on signal voltage law. A varied signal voltage can generate parasitic current flowing along the surface (ground) of the coaxial transmission line 27, thereby easily changing the antenna characteristic such as the directional pattern of the antenna, the input impedance thereof, and the gain thereof. Thus, to prevent the variation of such characteristics, the first and second radiators 24 and 25 are designed as follows: the first and second radiators 24 and 25 are opposed to each other centering around the Z-axis of the antenna on the PCB 21 thereof and the electrical length of each is designed as L=(2n−1)λ/4 (herein, n is a positive constant). That is, the electrical length of each of the first and second ground radiators 24 and 25 is designed as an odd multiple of one-quarter wavelength. If the electrical length of the first and second ground radiators 24 and 25 are equal to each other, the parasitic current flowing from the surface of the ground radiator 26 to the ground thereof can be minimized. Consequently, there will be little degradation of the antenna characteristic variation and of the radiation efficiency due to human body contact even if the ground of the two-way pager 10 is positioned adjacent to the human body.

Figure 2:
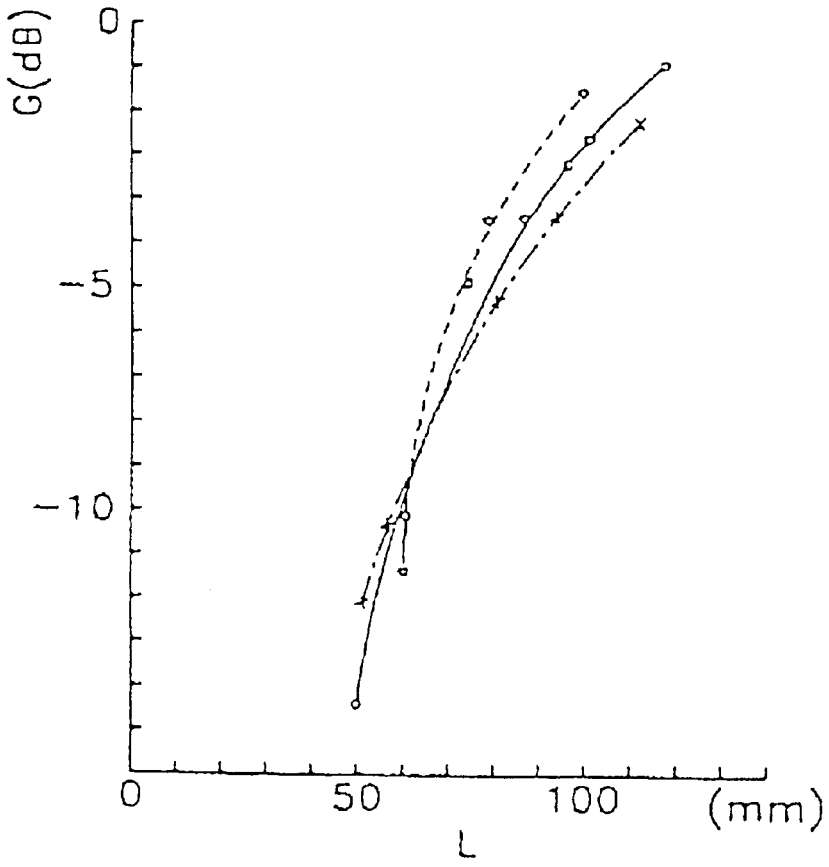
FIG. 2 is a diagram showing variation of the gain characteristic depending upon total length of the antenna of FIGS. 1A and 1B.
Figure 3:
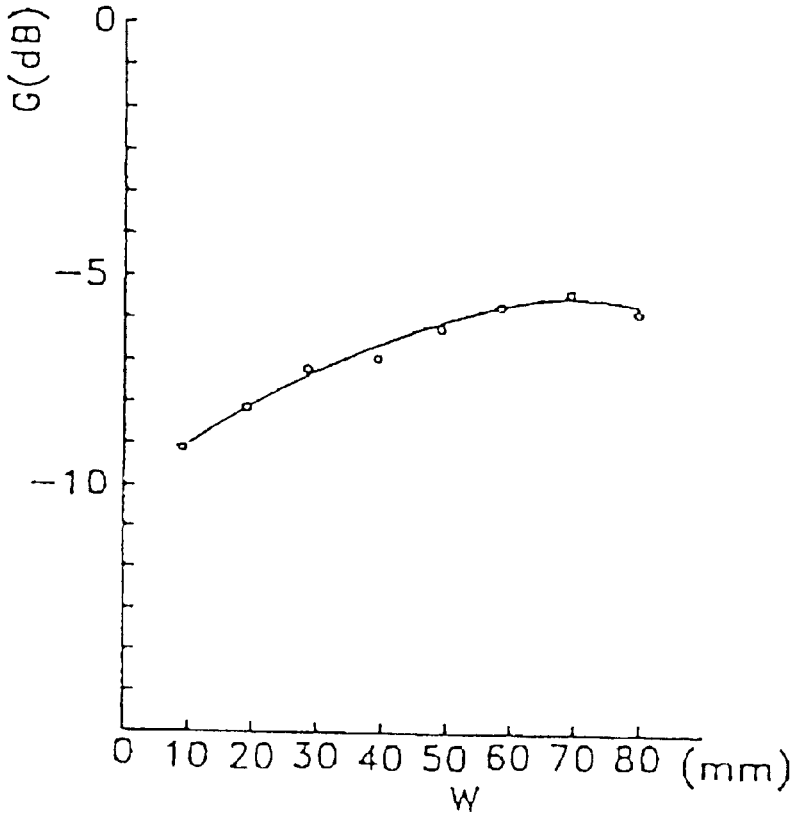
FIG. 3 is a diagram showing variation of the gain characteristic depending upon width of the antenna of FIGS. 1A and 1B.
Figure 4:
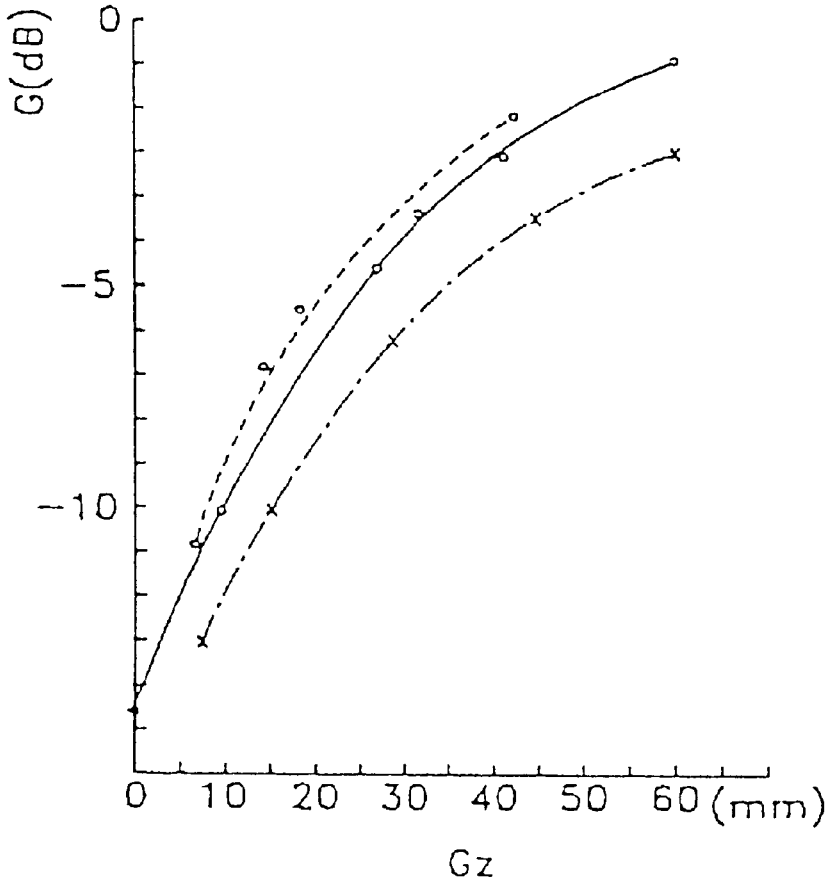
FIG. 4 is a diagram showing variation of the gain characteristic depending upon the un-metallized length Gz of the antenna of FIGS. 1A and 1B.
Figure 8:
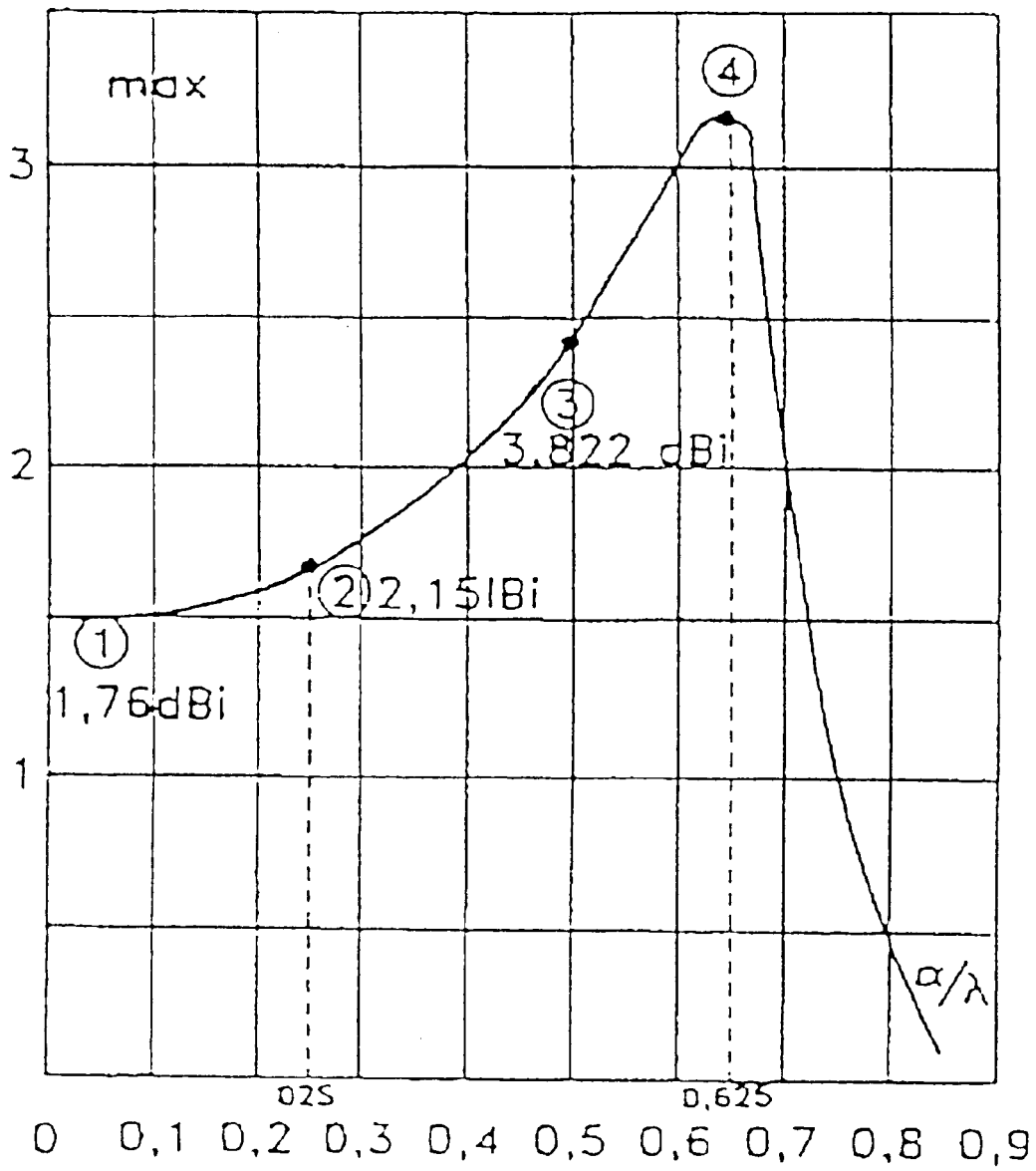
FIG. 8 is a graph showing gain versus length of a dipole antenna.

It can be understood from FIGS. 2 to 4 that the gain characteristic of the QMSA is a function of the lengths L and Gz and the width W of the antenna and that its gain characteristic is inferior to that of a dipole antenna. FIG. 8 shows a graph of gain versus length of a dipole antenna, which can be compared with FIGS. 2–4.

To recognize the above fact more clearly, a comparison can be made with an embodiment of the present invention and the prior art antenna. If the dimensions of an embodiment of an antenna according to the present invention (L=47.3 mm, $\epsilon_\gamma$=4.5, f=916 MHz) are adapted in the prior art antenna, a comparison can be made. The comparison of the gain between the antenna according to the present invention and the prior art antenna is as below.

Figure 1B:
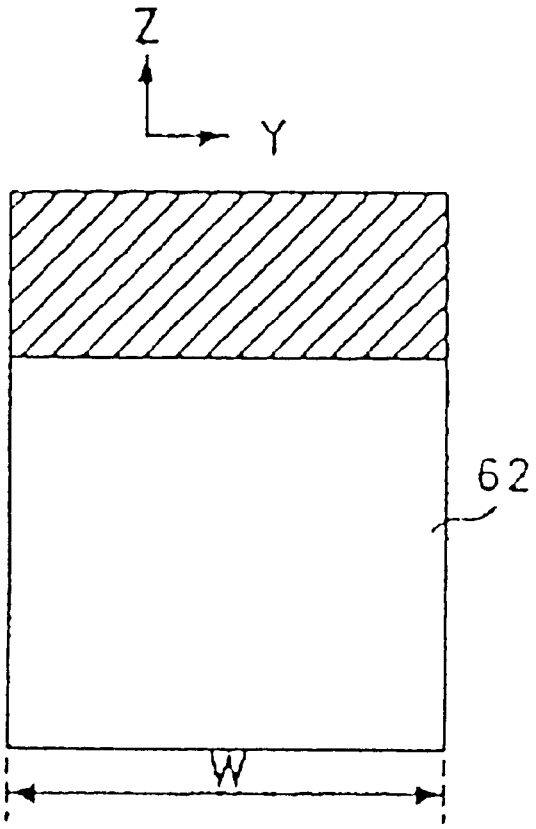

In FIG. 1, when assuming that $$b = \frac{\lambda s}{4},$$

L=47.3 mm, $\epsilon_\gamma$=4.5, f=916 MHz, and d=1.2 mm, λs, b, and Gz are shown in following expressions 6 to 8.

$$\lambda s = \frac{C}{f} = \frac{3\times10^{11}}{916\times10^{6}\sqrt{4.5}} = 154.5\ \mathrm{mm} \quad \text{[Expression6]}$$

$$b = \frac{\lambda s}{4} = 38.6\ \mathrm{mm} \quad \text{[Expression7]}$$

$$Gz=L-b=8.7\ mm \quad \text{Expression 8}$$

Figure 9:
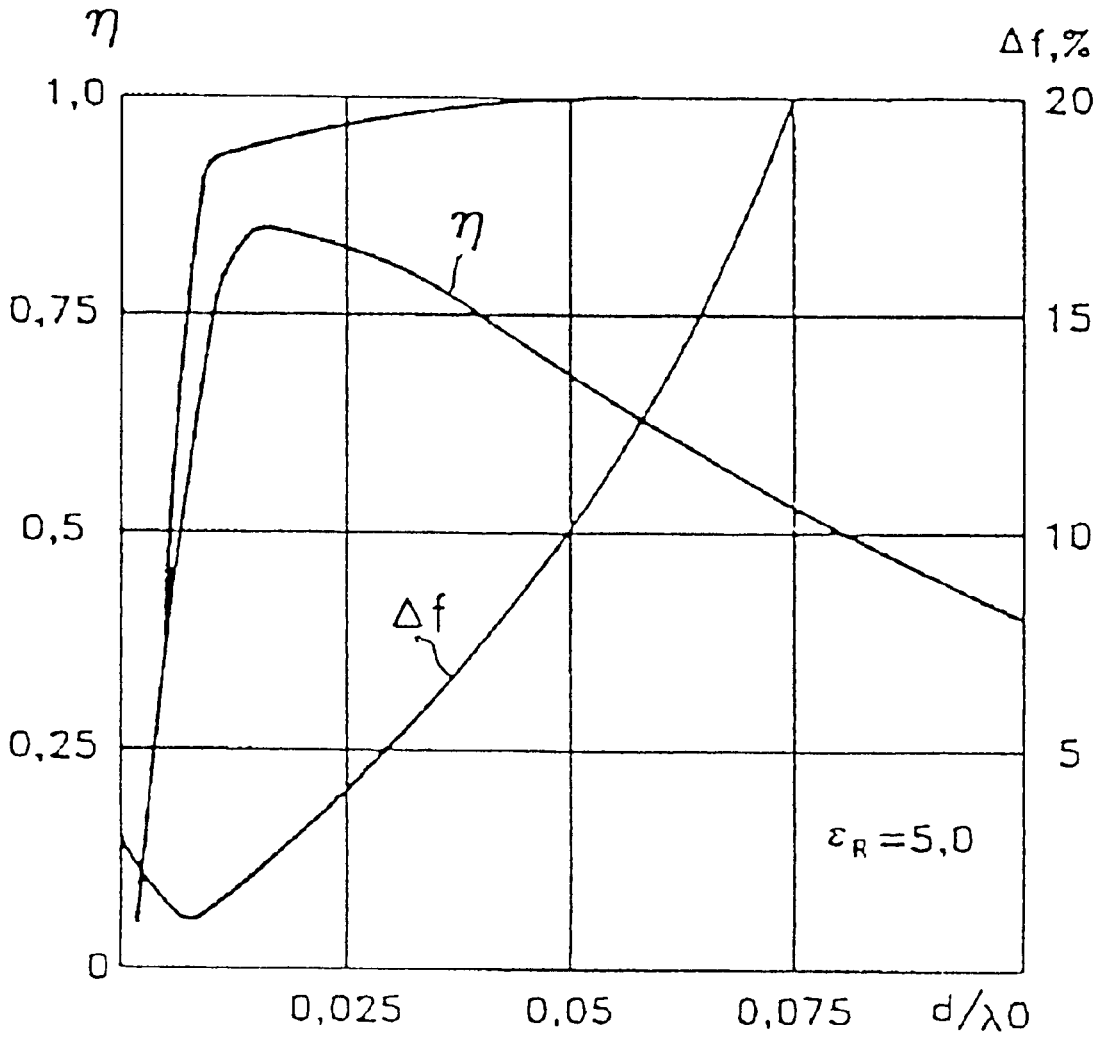
FIG. 9 is a graph showing gain versus width of a dipole antenna.

Regarding FIGS. 2 and 3, for the case in which L is 47.3 mm and Gz is 8.7 mm, the gain as shown in each figure is approximately −12.5 dBd (−10.35 dBi). The antenna used in the present embodiment has an electrical length of 0.625 λ. For this case, the gain of the present embodiment is about 3 dBd (5.15 dBi) with reference to FIG. 8. Thus, the prior art has a problem in that the gain can be degraded as much as about 15 dB. (It is noted that the graphs of FIGS. 8 and 9 are for a dipole antenna. However, the gain of a monopole antenna is essentially the same as that of an equivalent dipole antenna. Thus, FIGS. 8 and 9 also represent gain of a monopole antenna according to the present invention).

Another problem of the prior art is that the antenna efficiency characteristic η of the QMSA differs as a function of the thickness d of the PCB. When the specification of the antenna used in the present embodiment is adapted in the prior art antenna (L=47.3 mm, $\epsilon_\gamma$=4.5, f=916 MHz, d=0.25 mm), the gain according to the variation of the thickness d thereof with reference to FIG. 9 is as below. The gain of the aforesaid antenna specification has characteristic of about −12.5 dBd. Here, the thickness d is 1.2 mm and then, as shown in FIG. 9, the antenna efficiency is determined by following factors of expression 9.

$$F=d/\lambda o$$

$$\lambda o=c/f=3\times10/916\times10=327.5\ mm$$

$$F=1.2/327.5=0.003664 \quad \text{Expression 9}$$

Referring to FIG. 9, when F is 0.003664, the antenna efficiency is about 50%. When the thickness d of the PCB is 0.25 mm, F is 0.000736 and the antenna efficiency is approximately 4.5%.

Consequently, when d is 1.2 mm, η is about (≈)50%. When d is 0.25 mm, η is about 4.5%. The case of a thick PCB (that is, d is 1.2 mm) has about 11 times the gain value as the case of a thin PCB (that is, d is 0.25 mm). When calculating the gain by using the above result, the gain of the antenna will be given in following expression 10.

$$G=-12.5\ \text{dBd}-10\ \log 11=-22.9\ \text{dBd} \qquad \text{Expression 10}$$

Lastly, it can be seen from the above expression 10 that the gain is reduced by about 10 dB in comparison with the case of d equaling 1.2 mm. In addition, the gain is reduced by about 25 dB in comparison with the gain of the dipole antenna.

Since the antenna system according to the present invention can be embodied with a thin PCB, it is lightweight, highly portable and convenient to use, since it is simply installed at the upper surface of the terminal (e.g., paging device). Further, because the vertical radiator placed on the PCB is designed with a meander line shape, the physical length is advantageously reduced to obtain the best electrical characteristic for the limited size of the antenna. Furthermore, since the upper end of the vertical radiator uses another horizontal radiator and the vertical radiator is equivalently increased, it results in an enhanced gain for the antenna. Moreover, since the vertical and horizontal radiators and the ground radiator are embodied with one thin PCB, the antenna is easy to manufacture. Also, the ground radiator prevents the antenna current from flowing on the terminal ground. The variation of the antenna characteristics can be minimized depending upon the variation of the state of the terminal ground, for example, due to body contact. Therefore, the present invention is advantageous in that the antenna can be designed with stable and superior characteristics.

It should be understood that the present invention is not limited to the particular embodiment disclosed herein as the best mode contemplated for carrying out the present invention. While the above description contains many specifics, these specifics should not be construed as limitations on the scope of the invention, but merely as exemplifications of preferred embodiments thereof. Those skilled in the art will envision many possible variations that are within the scope of the invention as defined by the appended claims.

What is claimed is:

1. A small antenna for a portable radio device, comprising:

a loaded monopole radiator including a first conductor on a printed circuit substrate, said first conductor having a given length oriented in a horizontal direction, and a second conductor having a meander line shape and oriented in a vertical direction; and a ground radiator including separately a first ground and a second ground at a lower portion of said printed circuit substrate, said first and second grounds being symmetrical with respect to said second conductor.

2. The antenna as defined in claim 1, wherein said loaded monopole radiator includes a vertical conductor of a meander line shape and a loading line of a horizontal conductor extending right and left at an upper end of said vertical conductor.

3. The antenna as defined in claim 1, wherein said ground radiator has a meander line shape, said ground radiator is oriented symmetrical to said vertical conductor of said loaded monopole radiator, and a right portion of a left ground radiator and a left portion of a right ground radiator are connected to each other, whereby each electrical length of said right and left ground radiators is an odd multiple of one quarter wavelength.

4. The antenna as defined in claim 2, wherein said ground radiator has a meander line shape, said ground radiator is oriented symmetrical to said vertical conductor of said loaded monopole radiator, and a right portion of a left ground radiator and a left portion of a right ground radiator are connected to each other, whereby each electrical length of said right and left ground radiators is an odd multiple of one quarter wavelength.

5. The antenna as defined in claim 3, wherein said printed circuit substrate is installed at a portion of said device provided with a radio frequency amplifier, and connected thereto with a coaxial cable.

6. The antenna as defined in claim 5, wherein said coaxial cable has a signal line at one end connected at a lower portion of said second conductor of said loaded monopole radiator and a ground line thereof connected to said right and left ground radiators, a signal line at another end connected to a signal line of a terminal and a ground line thereof connected to a ground portion of said terminal, whereby said antenna and said terminal can be reciprocally connected to each other electrically.

7. The antenna as defined in claim 1, wherein said printed circuit substrate is installed in a flip antenna case.

8. The antenna as defined in claim 7, wherein said antenna case is composed of polycarbonate.

9. An antenna, comprising:

a loaded monopole radiator including first and second conductors on a printed circuit substrate, said first conductor having a given length oriented in a first direction, said second conductor having a meander line shape and oriented in a second direction perpendicular to said first direction; and a ground radiator including a first radiating portion disposed on a first side of said second conductor, and a second radiating portion disposed on a second side of said second conductor, said first and second radiating portions being connected to each other.

10. The antenna of claim 9 wherein said first and second radiating portions are oriented in said first direction.

11. The antenna of claim 9 wherein said first and second radiating portions are each of a meander line shape.

12. The antenna of claim 9 wherein at least one of said first and second radiating portions is capacitively coupled to said second conductor.

13. The antenna of claim 9 wherein only one of said first and second radiating portions is capacitively coupled to said second conductor.

14. The antenna of claim 9 wherein dimensions of said antenna are selected to permit said antenna to be used in conjunction with a hand-held, portable radio device.

* * * * *